United States Patent [19]

Shimono

[11] 4,287,918

[45] Sep. 8, 1981

[54] APPARATUS FOR MANUFACTURING A SLIDE FASTENER STRINGER HAVING A WOVEN COILED COUPLING ELEMENT

[75] Inventor: Muchiji Shimono, Namerikawa, Japan

[73] Assignee: Yoshida Kogyo K. K., Tokyo, Japan

[21] Appl. No.: 90,997

[22] Filed: Nov. 5, 1979

[30] Foreign Application Priority Data

Nov. 20, 1978 [JP] Japan ..... 53-142999

[51] Int. Cl.[3] ..... D03D 41/00

[52] U.S. Cl. ..... 139/35; 139/116

[58] Field of Search ..... 139/11 R, 35, 116

[56] References Cited

U.S. PATENT DOCUMENTS 3,827,463 8/1974 Glindmeyer ..... 139/35

*Primary Examiner*—Henry Jaudon

*Attorney, Agent, or Firm*—Hill, Van Santen, Steadman, Chiara & Simpson

[57] ABSTRACT

An apparatus for manufacturing a slide fastener stringer having a woven stringer tape and a coiled coupling element woven therein, includes a needle loom for weaving the stringer tape of warp and weft threads, a mandrel for extending at an angle to the warp threads, and a coiling rotor assembly to be located alongside of the warp threads for winding a monofilament around the mandrel in a circular path to form the coiled coupling element, which is then woven into the stringer tape by the weft thread. A monofilament guide means is fixed with respect to the coiling rotor assembly and is located in substantially, three-dimensional point-symmetry relation to a distal end portion of the mandrel with respect to the center of the circular path, so that the monofilament is kept under substantially uniform tension while being rotated by the coiling rotor assembly.

2 Claims, 2 Drawing Figures

APPARATUS FOR MANUFACTURING A SLIDE FASTENER STRINGER HAVING A WOVEN COILED COUPLING ELEMENT

BACKGROUND OF THE INVENTION

1 Field of the Invention

The present invention relates to an apparatus for manufacturing a slide fastener stringer including a woven stringer tape and a coiled coupling element woven into the stringer tape along a longitudinal edge thereof.

2 Prior Art

Known apparatus for producing a slide fastener stringer of the type described above generally comprise a shuttleless loom such as a needle loom for weaving a stringer tape and a rotor assembly operatively associated with the loom for supplying a monofilament and a core thread, the rotor assembly including a mandrel for extending along a longitudinal edge of the tape being formed and adjacent to the fell of the tape. The rotor assembly winds or coils the monofilament around the mandrel and the core thread fed therealong, thereby forming the coiled coupling element reinforced with the core thread as they are woven into the tape by being interlaced with weft threads inserted by filling carriers of the loom.

The rotor assembly comprised a housing, a wheel or rotor rotatable in the housing and having an axial off-center hole through which the monofilament passes, and a hollow axle around which the wheel is rotatable and through which the core thread is supplied from a bobbin on the axle, the mandrel being fixed to the axle. Since during operation of the apparatus the wheel revolves so as to turn the monofilament in an orbital motion around the axle, the axle floats in the wheel and is held nonrotatable only by the mandrel that engages the coiled coupling element wound therearound and woven into the stringer tape. Therefore, the axle is liable to get jiggled and turned about its own axis due primarily to frictional engagement with the revolving wheel and to vibrations transmitted from the mandrel around which monofilament coiling action takes place. Such movements of the axle in turn amplify vibratory movements of the mandrel which grow greater and greater as the wheel rotates at higher speeds. This condition has led to drawbacks in that the monofilament being coiled can be shaped irregularly and the weft threads being inserted tend to get loosened at the tape edge. Furthermore, the filling carriers which reciprocate across the mandrel to insert the weft threads may collide with the vibrating mandrel, whereby the mandrel can be bent or broken.

To solve such problems, there has been devised an apparatus for manufacturing a woven slide fastener stringer, as disclosed in U.S. Pat. No. 4,174,736 issued Nov. 20, 1979, assigned to the present assignee, the apparatus having a mandrel is held stationarily at all times with respect to the frame of the apparatus.

One problem with such apparatus is that since the mandrel extends obliquely with respect to the warp threads for the stringer tape, the monofilament is subjected to varying tension as it moves toward and away from the warp threads while revolving around the mandrel. The monofilament under fluctuating tension tends to be wound into irregular coils with enlarged coupling heads displaced out of position, resulting in poor quality and malfunctioning of slide fasteners.

If a relatively large bobbin of core thread were to be used, the rotor assembly has to be located away from the warp threads so that the bobbin will not interfere with the warp threads. With such an arrangement, however, the monofilament, as it moves around the mandrel forms a larger angle with respect to the warp threads than it would otherwise do, with the results that the monofilament would be supplied under more varying tension and the legs of formed coupling elements would be inclined with respect to the warp threads.

SUMMARY OF THE INVENTION

According to the present invention, a monofilament guide means in the form of an eyelet is fixed with respect to a coiling rotor assembly and is located in substantially three-dimensional point-symmetry to a distal end portion of a mandrel with respect to the center of a circular path that the monofilament follows while being rotated by the coiling rotor assembly. A length of the monofilament which extends between the monofilament guide means and the distal end portion of the mandrel around which the monofilament is coiled is kept substantially constant at all times and thus is tensioned to a substantially constant degree during revolving movement of the monofilament.

An object of the present invention is to provide an apparatus for manufacturing a woven slide fastener stringer, the apparatus having means for keeping the element-forming monofilament under constant tension while revolving around the mandrel.

Another object of the present invention is to provide an apparatus for manufacturing a woven slide fastener stringer having a coiled coupling element shaped to a predetermined nicety.

Many other advantages, features and additional objects of the present invention will become manifest to those versed in the art upon making reference to the detailed description and the accompanying drawings in which a preferred structural embodiment incorporating the principles of the present invention is shown by way of illustrative example.

DETAILED DESCRIPTION

Figure 1:
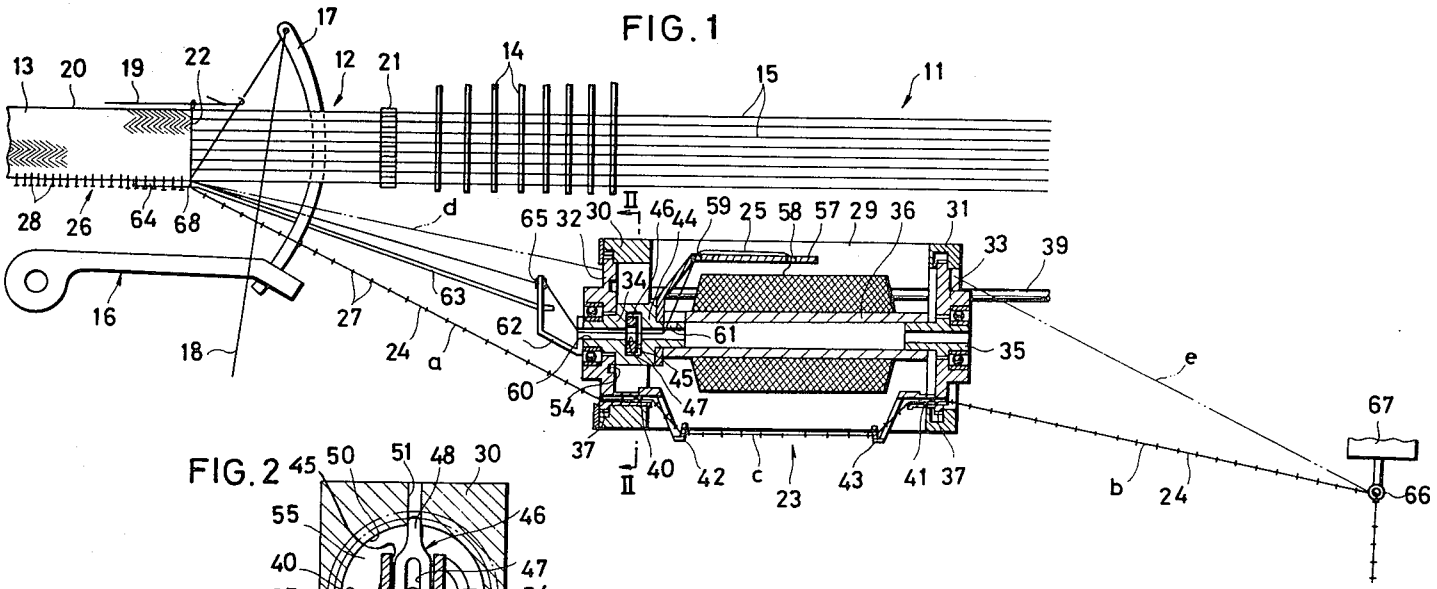
FIG. 1 is a plan view partly in cross section of an apparatus having a monofilament guiding eyelet constructed in accordance with the present invention.

The principles of the present invention are particularly useful when embodied in an apparatus such as shown in FIG. 1, generally indicated by the numeral 11.

The apparatus 11 includes a needle loom 12 of a known construction for producing a narrow, continuous slide fastener stringer tape 13, the loom 12 essentially comprising a plurality of hardnesses 14 for forming sheds by raising and lowering warp threads 15 selectively, a weft inserter 16 having a filling carrier 17 to insert a weft thread 18 through the warp sheds, a latch needle 19 reciprocable in warp direction along-side of one longitudinal edge of the tape 13 for catching and knitting the weft thread 18 carried by the filling carrier 17 so as to form a tape selvage 20 along said longitudinal tape edge, and a reed 21 for beating the weft thread 18 into the fell 22 of the tape 13.

The apparatus 11 of FIG. 1 further includes a coiling rotor assembly 23 disposed alongside of the warp shed for supplying a monofilament 24 and a core thread 25 and for winding or coiling the monofilament 24 in a conical orbital path so as to shape the monofilament 24 into a helically coiled coupling element 26 to be disposed along the tape edge remote from the selvaged edge 20. The monofilament 24 is made of plastic material and has a plurality of widened, flattened portions 27 spaced at predetermined intervals therealong, such portions 27 being formed as by stamping. The widened, flattened portions 27 permit the monofilament 24 to be bent or folded over easily at such portions when the monofilament 24 is being coiled, and alternate widened, flattened portions 27 serve as coupling heads 28 of the element 26.

The coiling rotor assembly 23 generally comprises a horizontal base 29, a pair of first and second housings 30,31 spaced from each other and extending upwardly from the base 29, a pair of first and second wheels 32,33 rotatably mounted in the first and second housings 30,31, respectively, and a pair of floating bushings 34,35, the wheels 32,33 being rotatably mounted around the bushing 34,35 respectively. The wheels 32,33 have peripheral teeth 37 which mesh in driven relation with gears 38 (only one shown in FIG. 2) disposed respectively in the housing 30,31 and mounted on a drive shaft 39 that is connected to a suitable electric motor (not shown).

The wheels 32,33 have a pair of holes 40,41, respectively that are aligned axially with one another and are located eccentrically of the bushings 34,35 and a pair of guides 42,43, respectively, that are positioned respectively adjacent to the holes 40,41.

Figure 2:
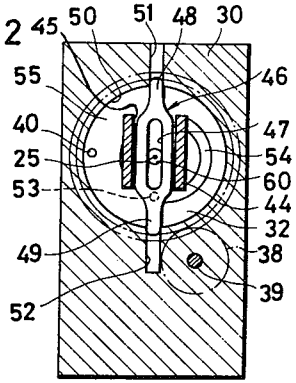
FIG. 2 is a cross-sectional view taken along line II—II of FIG. 1, showing a position of a pair of plungers for immovably holding a floating bushing relatively to a housing.

The bushing 34 includes a casing 44 having a vertical slot 45 extending therethrough. As best illustrated in FIG. 2, a cam follower 46 is slidably disposed in the vertical slot 45 and has a vertically oblong hole 47 through which the core thread 25 passes. The cam follower 46 has a pair of upper and lower plungers 48,49 directed away from each other and movable along a diametrical path across the wheel 32 when the cam follower reciprocates in the slot 45. The housing 30 has a circular opening 50 concentric with the wheel 32, and a pair of diametrically opposite, upper and lower recesses 51,52 opening to the circular opening 50 and located radially outwardly of the circular opening 50 and in the path of movement of the plungers 48,49 for receiving them, respectively. The cam follower 46 has a roller 53 disposed downwardly of the oblong hole 47 and received in a cam groove 54 disposed eccentrically in a face 55 of the wheel 32.

When the wheel 32 revolves, the guide 42 moves the monofilament in a circular orbit along the edge of the housing 30 which bounds the circular opening 50, such orbital path being intersected by the path of movement of the plungers 48,49. As the guide 42 moves in its orbit past a point that is angularly spaced 90 degrees apart from both the recesses 51,52 (FIG. 2), the cam follower 46 is substantially in the middle position of its stroke and the plunger 48,49 are disposed partly in the recesses 51,52, respectively, and engage the housing 30, so that the floating bushing 34 is held immovably with respect to the housing 30. Assuming that the wheel 32 rotates counterclockwise in FIG. 2, when the guide 42 approaches the lower recess 52, the cam follower 46 is caused to move upwardly, with the upper plunger 48 being inserted into the upper recess 51 and the lower plunger 49 being withdrawn out of the lower recess 52. Continued rotation of the wheel 32 introduces the upper plunger 48 fully in the upper recess 51 and retracts the lower plunger 49 out of the circular orbital path of the axis of the hole 40, whereupon the guide 42 clears the retracted lower plunger 49. At this time, the floating bushing 34 is maintained stationarily with respect to the housing 30 by the upper plunger 48. As the wheel 32 continues revolving counterclockwise, the cam follower 46 is lowered, thereby withdrawing the upper plunger 48 out of the upper recess 51 and inserting the lower plunger 49 into the lower recess 52. Thus, the guide 42 is allowed to move past the upper plunger 48 and to cross the path of movement of the cam follower 46, and at the same time, the lower plunger 49 keeps the floating bushing 34 immovable relatively to the housing 30.

With such an arrangement, the floating bushing 34 is maintained stationarily with respect to the housing 30 by engagement of the upper plunger 48, the lower plunger 49, or both, with the housing 30 wherever the guide 42 is in its rotational path.

FIG. 1 further illustrates a bobbin 36 for the core thread 25, supported rotatably on the bushings 34,35. A core thread guide arm 57 is secured to the bushing 34 and extends alongside the bobbin 36. The guide arm 57 has a pair of eyelets 58,59 through which the core thread 25 pays out of the bobbin 36. The core thread 25 as it is discharged passes through a radial hole 61 and an axial hole 60 in the bushing 34, the axial hole 60 extending across the slot 45.

The floating bushing 34 supports a mandrel support 62 on which there is mounted a mandrel 63 extending at an angle to the warp threads 15 and at an angle to the common axis of the floating bushings 34,35. The mandrel 63 includes at its distal end a needle portion 64 that lies substantially parallel to and is disposed close to the stringer tape 13 being woven, the needle portion 64 extending beyond the fell 22 of the stringer tape 13. The monofilament 24 is coiled around the needle portion 64 of the mandrel 63 to successively from the coiled coupling element 26 as the monofilament 24 revolves in a conical orbital path around the mandrel 63.

The mandrel support 62 has an eyelet 65. The monofilament 24 as it pays out passes through the hole 61, the hole 60 and then the eyelet 65 for being fed along the mandrel 63 toward the needle portion 64 thereof, at which the monofilament 24 is wound around the needle portion 64 and the core thread 25.

According to the present invention, a monofilament guide 66 in the form of an eyelet is fixedly mounted on a stationary support 67 fixed with respect to the base 29 of the coiling rotor assembly 23. The monofilament guide 66 is located substantially in three-dimensional point-symmetry relation to the distal end 68 of the needle portion 64 of the mandrel 63 with respect to the center of the coiling rotor assembly 23, that is, the central point on the axis of the cylindrical path that the monofilament 24 describes while being rotated by the first and second wheels 32,33 of the coiling rotor assembly 23.

The monofilament 24 as it is paid out of a bobbin (not shown) passes through the guiding eyelet 66 and is direceted to the hole 41 in the second wheel 33.

With such an arrangement, a first conical orbital path that the monofilament 24 follows between the first wheel 32 and the distal end 68 of the mandrel needle portion 64 is substantially identical in shape with a second conical orbital path that the monoflament 24 follows between the second wheel 33 and the monofilament guide 66. Stated otherwise, when the first and second wheels 32, 33 are in the position shown in FIG. 1, a portion of the monofilament 24 that extends between the guiding eyelet 66 and the distal end 68 of the mandrel needle portion 64 is located farthest from the warp threads 15, and has a length equal to a+b+c, where a is the distance between the outlet hole 40 and the distal end 68 of the mandrel needle portion 64, b the distance between the inlet hole 41 and the guiding eyelet 66, and c is the distance between the outlet hole 40 and the inlet hole 41. Upon angular movement of the wheels 32,33 through 180 degrees, the portion of the monofilament 24 is located closest to the warp threads 15 as indicated by the two-dot-dash line in FIG. 1. At this time, the length of that monofilament portion equals the sum of d+e+c, where d is the distance between the outlet hole 40 and the distal end 68 of the mandrel needle portion 64, e the distance between the inlet hole 41 and the guiding eyelet 66, and c the distance between the outlet hole 40 and the inlet hole 41. With the guiding eyelet 66 being located in point-symmetry relation to the distal end 68 of the mandrel needle portion 64, the distance a is substantially equal to the distance e and the distance b is substantially equal to the distance d. Accordingly, the overall length of the portion of the monofilament 24 which extends between the guiding eyelet 66 and the distal end 68 of the mandrel needle portion 64 through the coiling rotor assembly 23 is kept substantially constant at all times regardless of positions the monofilament 24 takes while it is being rotated by the coiling rotor assembly 23. The monofilament 24 therefore is tensioned to a substantially constant degree during its movement toward and away from the wrap threads 15 while rotating in its orbital path, with the result that the coiled coupling element is shaped to a nicety.

Although various minor modifications may be suggested by those versed in the art, it should be understood that I wish to embody within the scope of the patent warranted hereon, all such embodiments as reasonably and properly come with the scope of my contribution to the art.

I claim as my invention:

1. An apparatus for manufacturing a slide fastener stringer including a woven stringer tape and a coiled coupling element woven into the stringer tape along a longitudinal edge thereof, comprising:

(a) means for weaving the stringer tape of warp and weft threads;

(b) a mandrel for extending at an angle to the warp threads, said mandrel having a portion to be located adjacent to the fell of the stringer tape being woven;

(c) means for winding a monofilament around said portion of said mandrel to form the coiled coupling element, which is then woven into the stringer tape by the weft thread, said winding means having means for guiding the monofilament to revolve in a first conical orbital path; and (d) means for guiding the monofilament toward said winding means in a second conical orbital path, said last-mentioned guiding means being fixedly located in substantially three-dimensional point-symmetry relation to said portion of the mandrel with respect to the center of said winding means, whereby said first and second conical orbital paths are substantially identical in shape with each other, thereby allowing the length of a portion of the monofilament extending between said last-mentioned guide means and said portion of the mandrel to be kept substantially constant at all times to maintain the tension of said portion of the monofilament substantially uniform during revolving movement of the monofilament.

2. An apparatus according to claim 1, said last-mentioned guiding means comprising an eyelet fixed with respect to and spaced from said winding means for passage of the monofilament therethrough.

* * * * *